US005910702A

United States Patent [19]

Maehara

[11] Patent Number: 5,910,702

[45] Date of Patent: Jun. 8, 1999

[54] COLOR CATHODE RAY TUBE HAVING AN IMPROVED SHADOW MASK AND SHADOW MASK CONNECTOR

[75] Inventor: Mutsumi Maehara, Mobara, Japan

[73] Assignee: Hitachi, Ltd., Tokyo, Japan

[21] Appl. No.: 08/969,280

[22] Filed: Nov. 13, 1997

[30] Foreign Application Priority Data

Nov. 14, 1996 [JP] Japan ..... 8-303091

[51] Int. Cl.[6] ..... H01J 29/07

[52] U.S. Cl. ..... 313/407; 313/402; 313/408

[58] Field of Search ..... 313/402, 407, 313/408

[56] References Cited

U.S. PATENT DOCUMENTS

| | | | |
|---|---|---|---|
| 3,351,996 | 11/1967 | Fiore | 313/85 |
| 3,585,431 | 6/1971 | Long | 313/85 |
| 3,855,493 | 12/1974 | Snook et al. | 313/402 |
| 3,878,427 | 4/1975 | Godfrey | 313/402 |
| 3,912,963 | 10/1975 | Sedivy | 313/402 |
| 4,122,368 | 10/1978 | Masterton | 313/403 |
| 4,146,816 | 3/1979 | Morrell | 313/407 |
| 4,949,009 | 8/1990 | Iwamoto | 313/402 |
| 5,576,595 | 11/1996 | Inoue | 313/402 |

*Primary Examiner*—Vip Patel
*Assistant Examiner*—Matthew J. Gerike
*Attorney, Agent, or Firm*—Antonelli, Terry, Stout & Kraus, LLP

[57] ABSTRACT

A shadow mask type color cathode ray tube includes a generally rectangular shadow mask having a curved apertured portion having a multiplicity of electron-transmissive apertures, a curved imperforate portion surrounding and integral with the apertured portion and a skirt portion bent back from a periphery of the curved imperforate portion to form a rearwardly extending wall, and a generally rectangular support frame for suspending the shadow mask by spot welding the skirt portion thereto, within a panel portion of the color cathode ray tube, and at least one of short and long sides of the skirt portion contains only a pair of embossments extending in a direction parallel to a longitudinal axis of the color cathode ray tube on opposite sides of the spot welding point of the support frame and the skirt portion at a center of the at least one of short and long sides of the skirt portion within a distance of one fourth or less of a length of the at least one of short and long sides of the generally rectangular shadow mask from the center.

6 Claims, 7 Drawing Sheets

COLOR CATHODE RAY TUBE HAVING AN IMPROVED SHADOW MASK AND SHADOW MASK CONNECTOR

BACKGROUND OF THE INVENTION

The present invention relates to a shadow mask type color cathode ray tube, and particularly to a color cathode ray tube having a shadow mask having improved workability in welding a skirt portion of a press-formed shadow mask to a support frame and improved magnetic resistance characteristics of the welded shadow mask.

Generally, in a shadow mask type color cathode ray tube, a shadow mask is positioned adjacent to a phosphor screen formed on an inner surface of a faceplate of its panel portion with a support frame having a skirt portion of the press-formed shadow mask fitted therein and spot-welded thereto, and suspended within the panel portion.

FIGS. 5A to 5C are respectively structural views showing one example of a shadow mask used for a known color cathode ray tube, FIG. 5A being a front view of the shadow mask, FIG. 5B being an enlarged side view in the vicinity of a welding point of a skirt portion, FIG. 5C being an enlarged sectional view of a portion from an imperforate portion to the skirt portion.

In FIGS. 5A to 5C, reference numeral 41 designates a shadow mask, 42 an apertured portion, 43 an imperforate portion, 44 a skirt portion, and X a welding point.

The shadow mask 41 has a curved apertured portion 42 having a multiplicity of electron-transmissive apertures, a curved imperforate portion 43 surrounding and integral with the apertured portion 42 and a skirt portion 44 bent back from a periphery of the curved imperforate portion 43 to form a rearwardly extending wall, and is integrally formed by press-forming a multi-apertured sheet-like metal blank.

Since the sheet-like metal blank constituting the shadow mask 41 is very thin, the forming properties during press forming are not always good, and in addition, since the strength of the metal blank is also relatively weak, the shape of the shadow mask 41 formed by press-forming is naturally limited. A corner portion of the shadow mask 41 is bent back smoothly from the curved imperforate portion 43 to blend into a rearwardly extending skirt portion 44, or is bent back from the curved imperforate portion 43 with one or more linear steps to blend into the rearwardly extending skirt portion 44, and side portions of the shadow mask are bent back from the curved imperforate portion 43 with a relatively small radius to blend into the rearwardly extending skirt portion 44. The side portions of the skirt portion 44 of the shadow mask 41 flare and curl outwardly by a distance ΔS with respect to the boundary between the imperforate portion 43 and the skirt portion 44 as shown in FIG. 5C. The press-formed shadow mask 41 is fixed to a support frame (not shown) by fitting the skirt portion 44 of the shadow mask 41 within the support frame (or around the support frame in rare cases) and then spot-welding the skirt portion 44 to the support frame at several positions. The welding points between the skirt portion 44 and the support frame include, for example, one at two respective long sides of the shadow mask 41, one at two respective short sides, and one at the corners, as indicated by X in FIG. 5B.

In the known shadow mask 41, the curl ΔS of the skirt portion 44 tends to become large when it is press-formed. There is a problem in that when the curl ΔS exceeds an allowable value, the curl ΔS interferes with the fitting of the shadow mask 41 into the support frame, resulting in a poor workability during the fitting operation.

There is a further problem in that in the known shadow mask 41, if the skirt portion 44 having a large ΔS is forcibly fitted in the support frame, a stress applied to the skirt portion 44 is transmitted to even the imperforate portion 43 and the apertured portion 42 so that the curved shape of the apertured portion 42 of the shadow mask 41 is deformed, and the color selection property of the shadow mask 41 is degraded.

Still a further problem is that in the known shadow mask 41, if the skirt portion 44 has a large curl ΔS, when the skirt portion 44 is fitted in the support frame, the intimate contact between the skirt portion 44 and the support frame cannot be obtained, and the magnetic resistance between the skirt portion and the support frame increases so that the magnetic resistance of the shadow mask 41 is deteriorated, and the color selection property is degraded under the influence of the earth's magnetic field.

SUMMARY OF THE INVENTION

The present invention solves these problems as noted above. An object of the present invention is to provide a color cathode ray tube having a shadow mask which reduces curls in the vicinity of welding points occurring in a skirt portion of a press-formed shadow mask, improves workability in welding, and prevents deformation of a curved shape and a magnetic resistance property from being deteriorated.

For achieving the aforementioned object, a shadow mask type color cathode ray tube of the present invention includes a generally rectangular shadow mask having a curved apertured portion having a multiplicity of electron-transmissive apertures, a curved imperforate portion surrounding and integral with the apertured portion and a skirt portion bent back from a periphery of the curved imperforate portion to form a rearwardly extending wall, and a generally rectangular support frame for suspending the shadow mask by spot welding the skirt portion thereto, within a panel portion of the color cathode ray tube, and at least one of short and long sides of the skirt portion contains only a pair of embossments extending in a direction parallel to a longitudinal axis of the color cathode ray tube on opposite sides of the spot welding point of the support frame and the skirt portion at a center of the at least one of short and long sides of the skirt portion, within a distance of one fourth or less of a length of the at least one of short and long sides of the generally rectangular shadow mask from the center. Since the embossments extending in a direction parallel to a longitudinal axis of the color cathode ray tube is provided on opposite sides of the spot-welding point of the skirt portion to the support frame, occurrence of unacceptable sizes of curls in the vicinity of the welding portion of the skirt portion in press forming is prevented.

BRIEF DESCRIPTION OF THE DRAWINGS

In the drawings, which form an integral part of the specification and are to be read in conjunction therewith, and in which like reference numerals designate similar components throughout the figures, and in which.

DETAILED DESCRIPTION OF THE PREFERRED EMBODIMENTS

In an embodiment of the present invention, a color cathode ray tube includes a generally rectangular shadow mask having a curved apertured portion having a multiplicity of electron-transmissive apertures, a curved imperforate portion surrounding and integral with the apertured portion and a skirt portion bent back from a periphery of the curved imperforate portion to form a rearwardly extending wall, and a generally rectangular support frame for suspending the shadow mask by spot welding the skirt portion thereto, within a panel portion of the color cathode ray tube, and at least one of short and long sides of the skirt portion containing a pair of embossments extending in a direction parallel to a longitudinal axis of the color cathode ray tube on opposite sides of the spot welding point of the support frame and the skirt portion at a center of the at least one of short and long sides of the skirt portion with no embossments other than the pair of embossments being within the distance of one fourth of the length of the at least one of short and long sides of the shadow mask from the center.

In a first embodiment of the present invention, the embossments are arcuate in cross section and protruding inwardly from the skirt portion.

In a second embodiment of the present invention, the embossments are arcuate in cross section and protruding outwardly from the skirt portion.

The embossments are preferably provided at a position within a distance of one fourth or less of a length of the sides of the shadow mask where the embossments are formed, from the welding point.

According to the embodiments of the present invention, when the shadow mask is formed by press forming, the embossments extending in a direction of the height of the skirt portion, that is, a direction parallel to the longitudinal axis of the cathode ray tube, are formed on the opposite sides of the welding point in the skirt portion to the support frame. Curls occurring in the vicinity of points in the skirt portion to be welded to a support frame in press-forming a shadow mask are suppressed by the embossments to within an acceptable limit in size.

Further, according to the embodiments of the present invention, since no large curls occur in the vicinity of the portion of the skirt portion to be welded to the support frame, the workability in fitting the skirt portion of the shadow mask into the support frame is improved, the stress is not applied to the apertured portion of the shadow mask after the skirt portion has been fitted in the support frame, no distortion occurs in the apertured portion, the intimate contact between the skirt portion and the support frame in the vicinity of the welding portion of the skirt portion is secured, and the magnetic property of the shadow mask is not deteriorated.

The embodiments of the present invention will be explained hereinafter with reference to the drawings.

Figure 1:
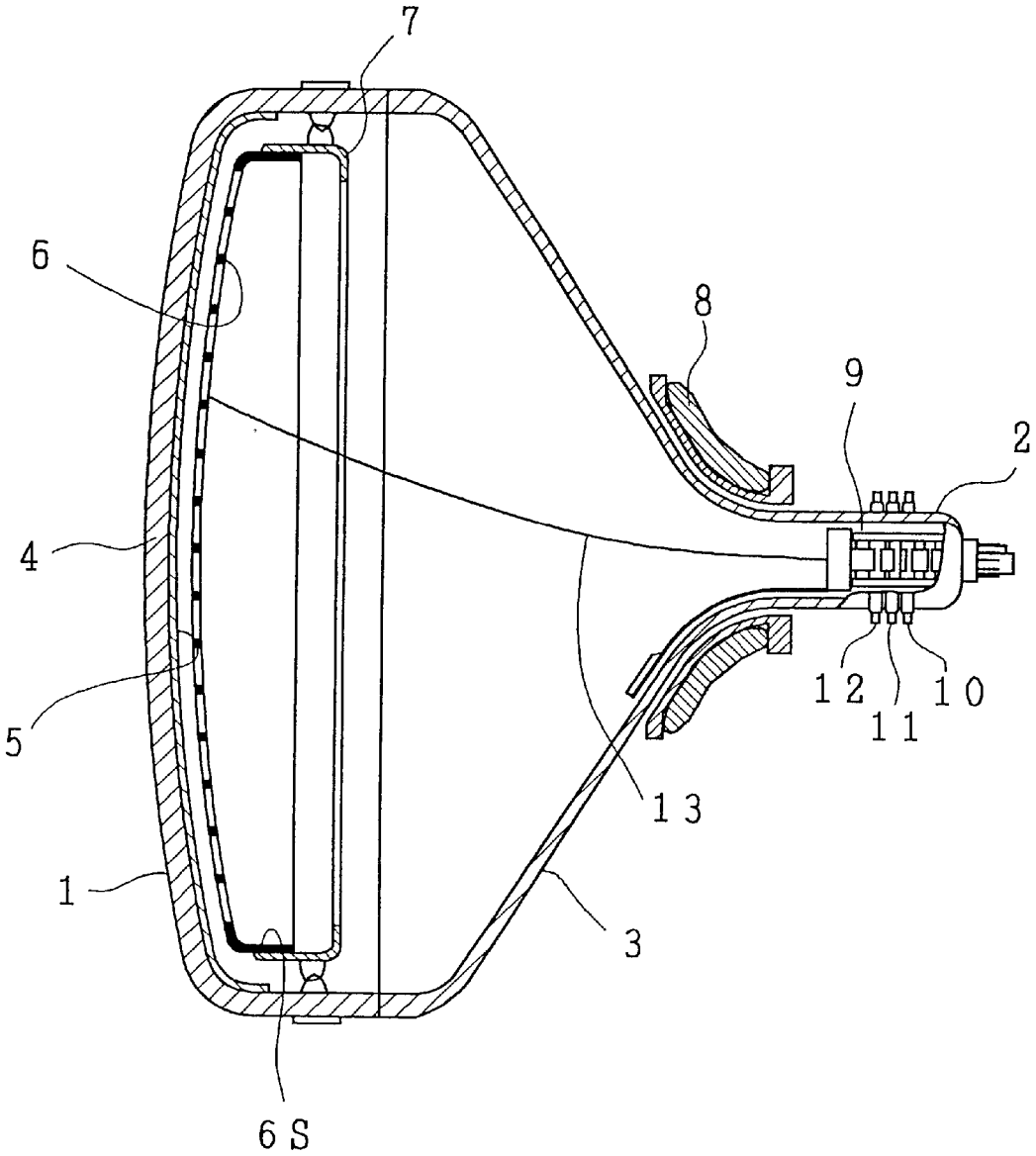
FIG. 1 is a sectional view showing a schematic structure of an embodiment of a color cathode ray tube having a shadow mask according to the present invention.

FIG. 1 is a sectional view showing a schematic structure of an embodiment of a color cathode ray tube having a shadow mask according to the present invention.

In FIG. 1, reference numeral 1 designates a panel portion, 2 a neck portion, 3 a funnel portion, 4 a faceplate, 5 a phosphor screen, 6 a shadow mask, 6S a skirt portion, 7 a support frame, 8 a deflection yoke, 9 an electron gun, 10 a purity adjustment magnet, 11 a four-pole magnet for static convergence adjustment, 12 a six-pole magnet for static convergence adjustment, and 13 an electron beam.

An evacuated envelope (bulb) of a color cathode ray tube comprises the panel portion 1 disposed in front, the elongated tubular neck portion 2 housing the electron gun 9 therein, and the funnel portion 3 for connecting the panel portion 1 and the neck portion 2. The panel portion 1 has the faceplate 4 in front, and the phosphor screen 5 is deposited on the inner surface of the faceplate 4. The support frame 7 is secured to an inner peripheral portion of the panel portion 1, and the skirt portion 6S of the shadow mask 6 is welded to the support frame 7 so that the shadow mask 6 is adjacent to the phosphor screen 5. The deflection yoke 8 is disposed around a junction of the funnel portion 3 and the neck portion 2. Externally of the neck portion 2 are juxtaposed the purity adjustment magnet 10, the four-pole magnet 11 for static convergence adjustment, and the six-pole magnet 12 for static convergence adjustment so that three electron beams 13 (only one of which is shown in FIG. 1) projected from the electron gun 9 pass through, after having been deflected by the deflection yoke 8, the electron-transmissive aperture of the shadow mask 6 and impinge on the phosphor screen 5.

In this case, the operation of the color cathode ray tube according to the present embodiment, that is, the image displaying operation is almost the same as the image displaying operation in the known color cathode ray tube of this kind, and such an operation is well known in the art of this field. Therefore, the explanation of the image displaying operation in the color cathode ray tube in the present embodiment will be omitted.

Figure 2A:
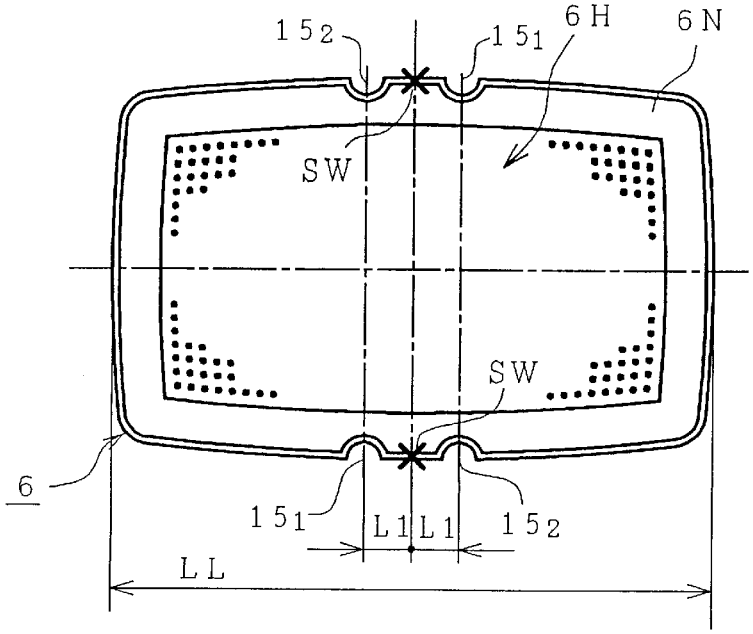
FIGS. 2A to 2E are respectively structural views showing a first embodiment of the present invention of the shadow mask used in the color cathode ray tube shown in FIG. 1, FIG. 2A being a front view of the shadow mask, FIG. 2B being a partly enlarged perspective view of a portion in the vicinity of a welding point of a long side, ranging from an imperforate portion to a skirt portion, FIG. 2C being a partly enlarged perspective view of a portion in the vicinity of a welding point of a short side, ranging from an imperforate portion to a skirt portion, FIG. 2D being a front view showing an example in which the shadow mask is fitted in a normal frame, and FIG. 2E being a front view showing an example in which the shadow mask is fitted in a frame having bosses at four sides thereof.
Figure 2C:
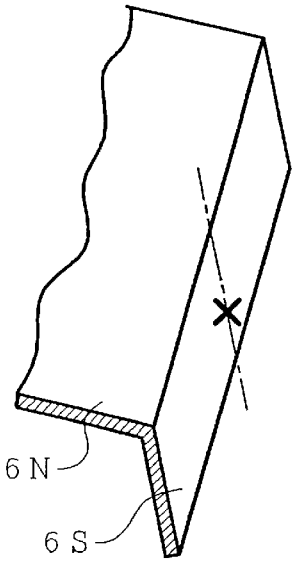
Figure 2B:
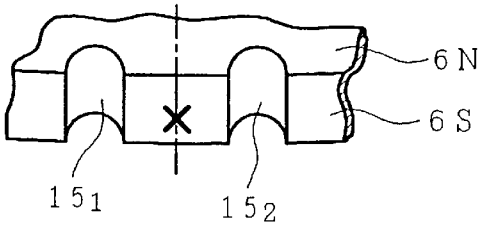
Figure 2D:
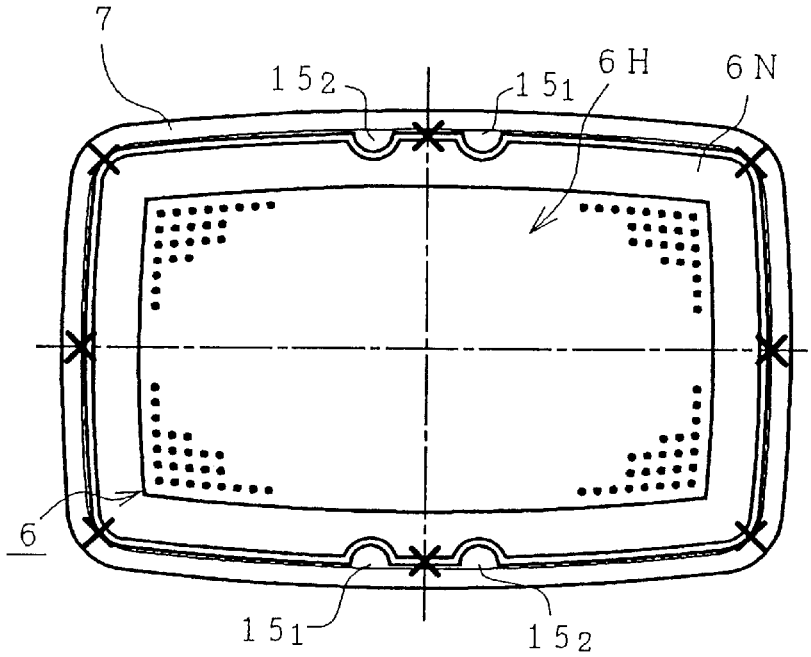
Figure 2E:
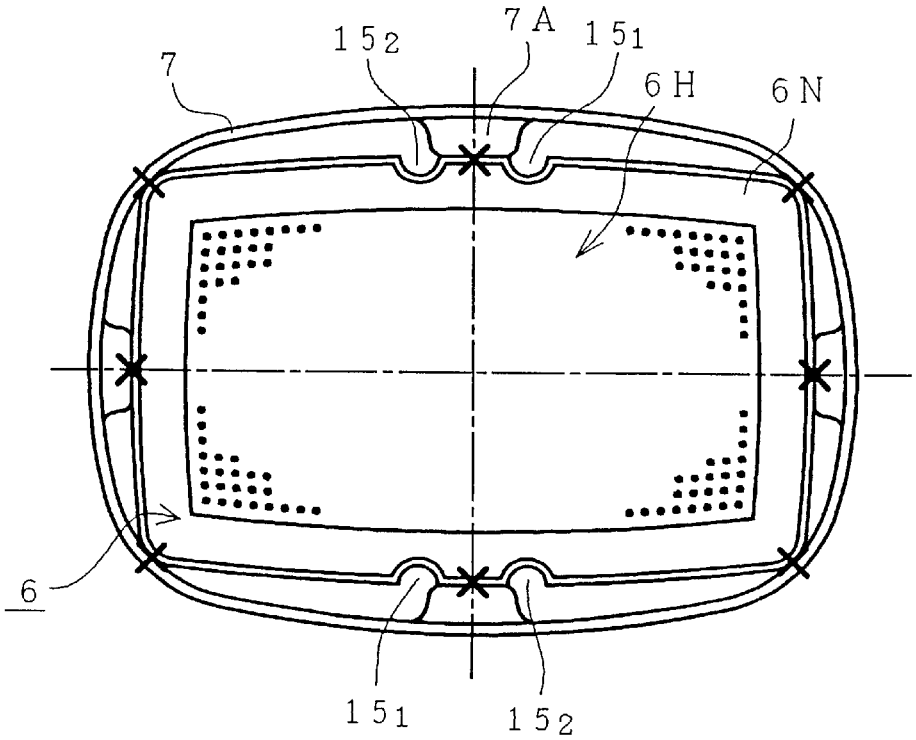

FIGS. 2A to 2E are respectively structural views showing a first embodiment of the present invention of the shadow mask used in the color cathode ray tube shown in FIG. 1, FIG. 2A being a front view of the shadow mask, FIG. 2B being a partly enlarged perspective view of a portion in the vicinity of a welding point of a long side of the shadow mask ranging from an imperforate portion to a skirt portion, FIG. 2C being a partly enlarged perspective view of a portion in the vicinity of a welding point of a short side of the shadow mask ranging from an imperforate portion to a skirt portion, FIG. 2D being a front view showing an example in which a shadow mask 6 is fitted in a normal frame 7, and FIG. 2E being a front view showing an example in which a shadow mask 8 is fitted in a frame 7 having bosses 7A at four sides thereof. Reference character X's designate welding points.

In FIGS. 2A to 2E, reference numeral 6H designates an apertured portion, 6N an imperforate portion, $\mathbf{15}_1$, $\mathbf{15}_2$ embossments, and other constituent parts which are the same as those shown in FIG. 1 are indicated by the same reference numerals as in FIG. 1. X's denote welding points.

The shadow mask 6 comprises a curved apertured portion 6H having a multiplicity of electron-transmissive apertures, an imperforate portion 6N surrounding and integral with the apertured portion 6H, and a skirt portion 6S bent back from a periphery of the curved imperforate portion 6N. As shown in FIG. 2B, a pair of embossments $\mathbf{15}_1$, $\mathbf{15}_2$ which are arcuate in cross section (for example, of 3 mm in radius) extending in a height direction of the skirt portion 6S and reaching a boundary portion between the skirt portion 6S and the imperforate portion 6N are provided in the vicinity of and on opposite sides of the welding point X in the skirt portion 6S on the long side of the shadow mask 6. These embossments $\mathbf{15}_1$, $\mathbf{15}_2$ protrude inwardly of the skirt portion 6S, and are integrally formed with the skirt portion 6S when an apertured sheet-like metal blank is press-formed.

The embossments $\mathbf{15}_1$, $\mathbf{15}_2$ are preferably provided such that a distance L1 measured from a point SW to be welded is within a distance of one fourth or less of a length LL of the long side where the embossments are formed and as shown, no other embossments are provided within the maximum one fourth length distance.

Figure 3A:
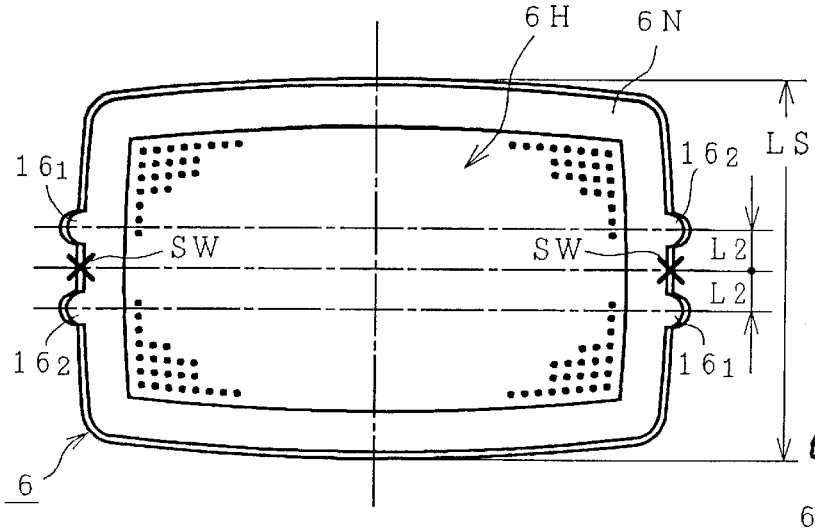
FIGS. 3A to 3E are respectively structural views showing a second embodiment of the present invention of the shadow mask used in the color cathode ray tube shown in FIG. 1, FIG. 3A being a front view of the shadow mask, FIG. 3B being a partly enlarged perspective view of a portion in the vicinity of a welding point of a long side ranging from an imperforate portion to a skirt portion, FIG. 3C being a partly enlarged perspective view of a portion in the vicinity of a welding point of a short side ranging from an imperforate portion to a skirt portion, FIG. 3D being a front view showing an example in which a shadow mask 6 is fitted in a normal frame, and FIG. 3E being a front view showing an example in which a shadow mask is fitted in a frame having bosses at four sides thereof.
Figure 3C:
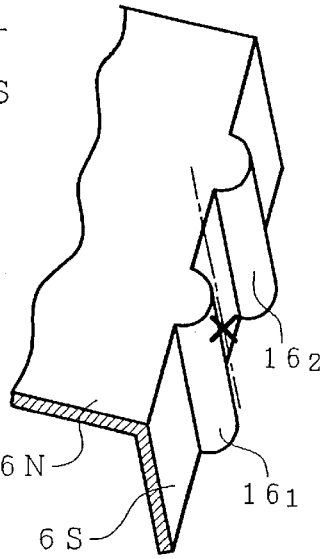

As shown in FIG. 3C, no embossments are not provided in the vicinity of and on opposite sides of the welding point X in the skirt portion 6S on the short side of the shadow mask 6.

Relatively larger curls occur at the long sides of the skirt portion 6S than at other locations of the skirt portion when the apertured sheet-like metal blank is press-formed to form the skirt portion 6S. With this constitution, the pair of embossments $\mathbf{15}_1$, $\mathbf{15}_2$ are provided in the vicinity of and on opposite sides of the weld points indicated by X's so that the sizes of curls occurring in the vicinity of the weld points X's in the skirt portion 6S are suppressed not to exceed a predetermined value by provision of the pair of embossments $\mathbf{15}_1$, $\mathbf{15}_2$.

As described above, in the shadow mask 6 according to the first embodiment, since curls occurring in the skirt portion 6S is reduced to be relatively small, the skirt portion 6S can be fitted in the support frame 7 relatively easily, thus improving the workability in the fitting operation.

Further, in the shadow mask 6 according to the first embodiment, since the curls occurring in the skirt portion 6S are relatively small, when the skirt portion 6S is fitted in the support frame 7, the stress applied to the skirt portion 6S is small. The stress is not transmitted to the apertured portion 6H through the imperforate portion 6N and occurrence of deformation of the apertured portion 6H is prevented.

Furthermore, in the shadow mask 6 according to the first embodiment, since the curls occurring in the skirt portion 6S are relatively small, when the skirt portion 6S is fitted in the support frame 7, the intimate contact between the skirt portion 6S and the support frame 7 is improved, as a result of which the magnetic resistance of the contact portion is small and the deterioration of the magnetic property of the shadow mask 6 is prevented.

Figure 3B:
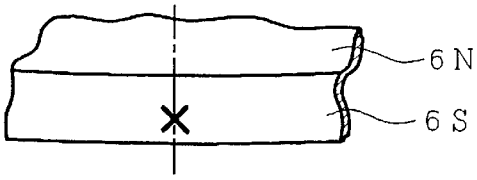
Figure 3D:
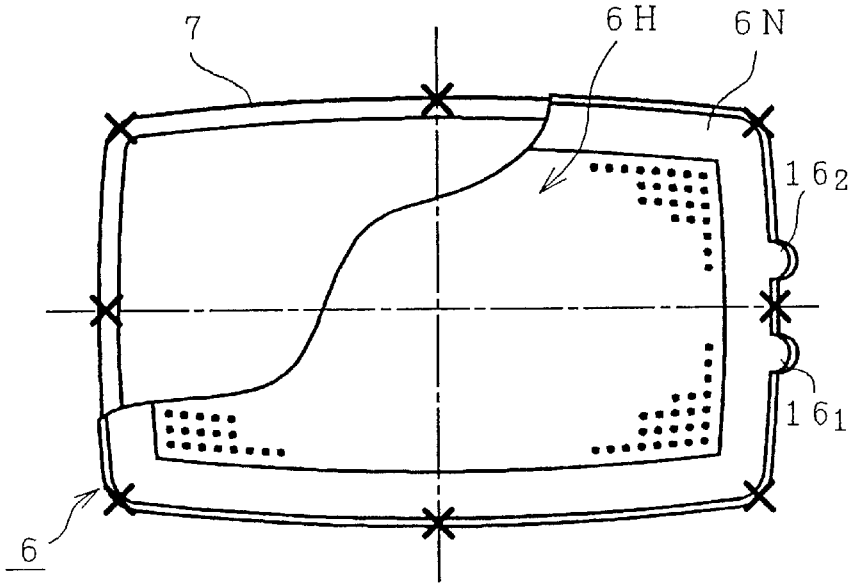
Figure 3E:
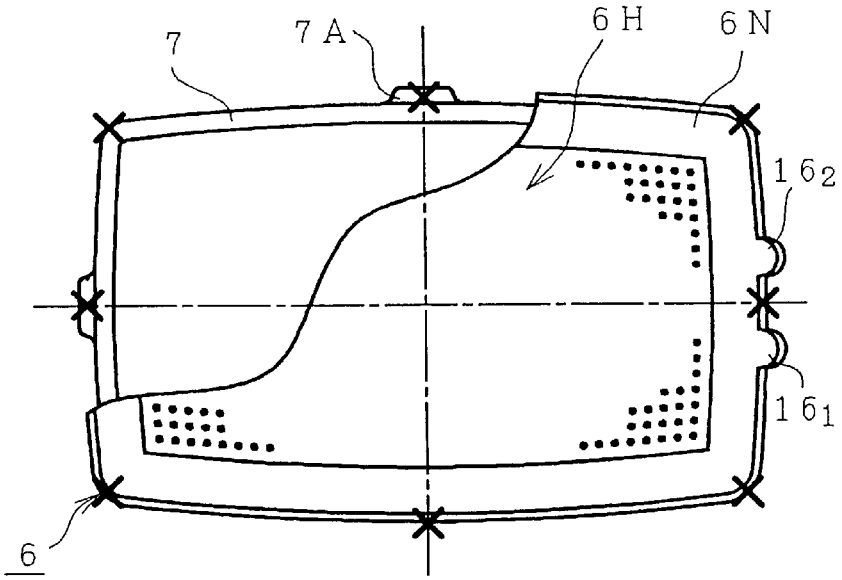

FIGS. 3A to 3E are respectively structural views showing a second embodiment of the present invention of the shadow mask used in the color cathode ray tube shown in FIG. 1, FIG. 3A being a front view of the shadow mask, FIG. 3B being a partly enlarged perspective view of a portion in the vicinity of a welding point of a long side of the shadow mask ranging from an imperforate portion to a skirt portion, FIG. 3C being a partly enlarged perspective view of a portion in the vicinity of a welding point of a short side of the shadow mask ranging from an imperforate portion to a skirt portion, FIG. 3D being a front view showing an example in which a shadow mask 6 is fitted in a normal frame 7, and FIG. 3E being a front view showing an example in which a shadow mask 6 is fitted in a frame 7 having bosses at four sides thereof. X's denote welding points.

In FIGS. 3A to 3C, reference numerals $\mathbf{16}_1$, $\mathbf{16}_2$ designate embossments, and other constituent parts which are the same as those shown in FIG. 1 and FIGS. 2A to 2C are indicated by the same reference numerals as in FIG. 1 and FIGS. 2A to 2C.

A difference in constitution between the second embodiment and the aforementioned first embodiment is that in the first embodiment, the pair of embossments $\mathbf{15}_1$, $\mathbf{15}_2$ are formed in the vicinity of and on opposite sides of the welding point X's in the skirt portion 6S on the long sides of the shadow mask 6 whereas in the second embodiment, the pair of embossments $\mathbf{16}_1$, $\mathbf{16}_2$ (for example, arcuate of 3 mm in radius) are formed in the vicinity of and on opposite sides of the welding points X's in the skirt portion 6S on the short sides of the shadow mask 6 and that in the first embodiment, the pair of embossments $\mathbf{15}_1$, $\mathbf{15}_2$ are formed so as to protrude inwardly of the skirt portion 6S whereas in the second embodiment, the pair of embossments $\mathbf{16}_1$, $\mathbf{16}_2$ are formed so as to protrude outwardly of the skirt portion 6S.

The embossments $\mathbf{16}_1$, $\mathbf{16}_2$ are preferably provided such that a distance L2 measured from a point SW to be welded is within a distance of one fourth or less of a length LS of the short side where the embossments are formed. With respect to others, no difference in constitution exists between the second embodiment and the first embodiment.

Further, since the operation of the second embodiment and the effect resulting therefrom are almost the same as the operation of the first embodiment already described and the effect resulting therefrom, the description of the operation of the second embodiment and the effect resulting therefrom will be omitted.

It is to be noted that the first embodiment and the second embodiment illustrate an example in which the pair of embossments $\mathbf{15}_1$, $\mathbf{15}_2$ and the pair of embossments $\mathbf{16}_1$, $\mathbf{16}_2$ are formed only in the vicinity of and on opposite sides of the welding points X's in the skirt portion 6S on the long side or short side of the shadow mask 6 within the aforementioned distance.

Figure 4A:
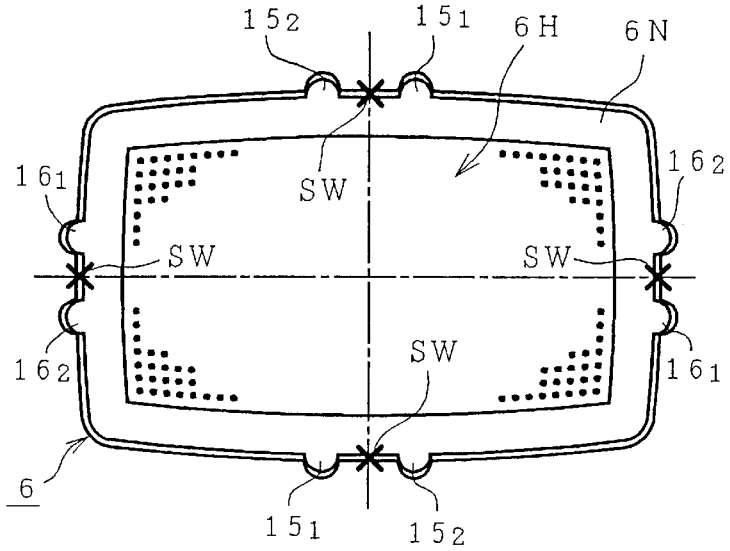
FIGS. 4A to 4C are respectively structural views showing a third embodiment of the present invention of the shadow mask used in the color cathode ray tube shown in FIG. 1, FIG. 4A being a front view of the shadow mask, FIG. 4B being a partly enlarged perspective view of a portion in the vicinity of a welding point of a long side ranging from an imperforate portion to a skirt portion, and FIG. 4C being a partly enlarged perspective view of a portion in the vicinity of a welding point of a short side ranging from an imperforate portion to a skirt portion.
Figure 4C:
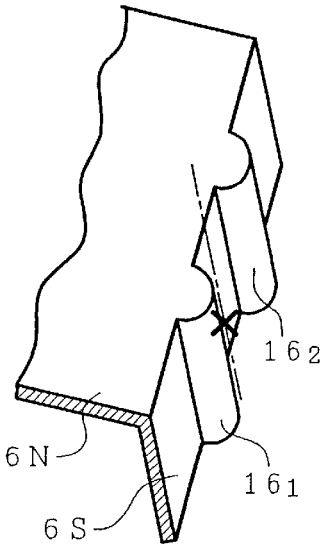
Figure 4B:
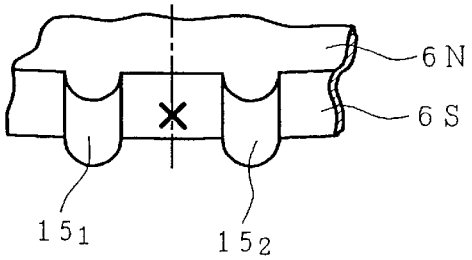
Figure 5A:
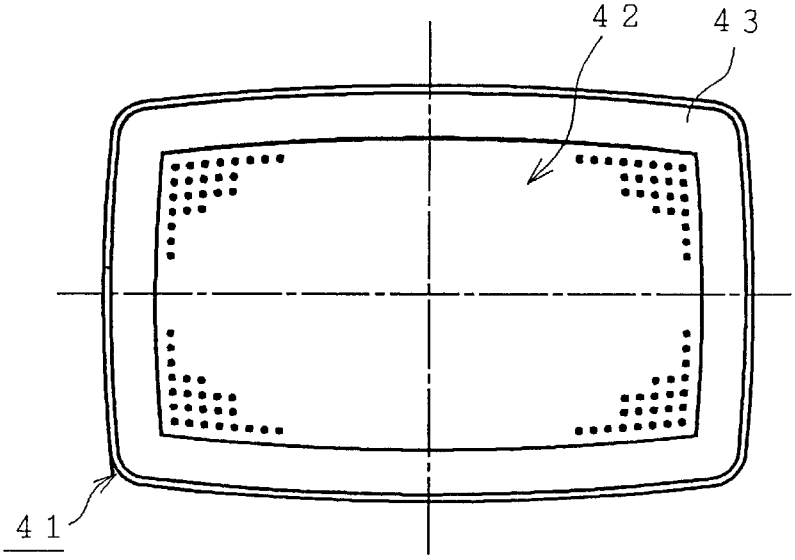
FIGS. 5A to 5C are respectively structural views showing one example of a shadow mask used in a conventional color cathode ray tube, FIG. 5A being a front view of a shadow mask, FIG. 5B being an enlarged side view in the vicinity of welding point of a skirt portion, FIG. 5C being an enlarged side view of a portion from an imperforate portion to a skirt portion.
Figure 5B:
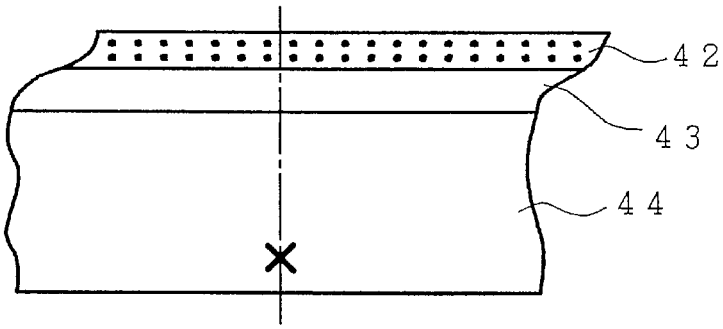
Figure 5C:
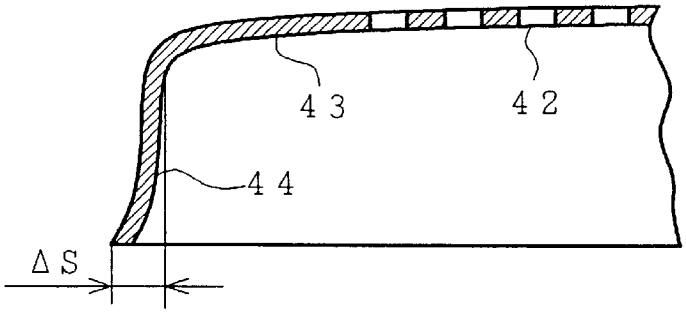

FIGS. 4A to 4C are respectively structural views showing a third embodiment of the present invention of the shadow mask used in the color cathode ray tube shown in FIG. 1, FIG. 4A being a front view of the shadow mask, FIG. 4B being a partly enlarged perspective view of a portion in the vicinity of a welding point of a long side of the shadow mask ranging from an imperforate portion to a skirt portion, and FIG. 4C being a partly enlarged perspective view of a portion in the vicinity of a welding point of a short side of the shadow mask ranging from an imperforate portion to a skirt portion. In the third embodiment of the present invention, the pair of embossments $\mathbf{15}_1$, $\mathbf{15}_2$ and the pair of embossments $\mathbf{16}_1$, $\mathbf{16}_2$ are formed in the vicinity of and on opposite sides of the welding points X's in the skirt portion 6S on both the long sides and short sides of the shadow mask 6. In case of the third embodiment, it is possible to restrict to a fixed value or less, curls occurring in the skirt portions 6S on both the long sides and short sides of the shadow mask 6, achieving both the operations and effects exhibited by the first and second embodiments.

As described above, according to the present invention, when the shadow mask is formed by press forming, the embossments extending in a direction of a height of the skirt portion are formed on opposite sides of the portions welded to the support frame in the skirt portions on at least one of the long sides and short sides of the shadow mask. Therefore, the curls occurring in the vicinity of the welding portion of the skirt portion in press-forming is restricted to within a fixed value by the formation of the embossments to prevent occurrence of large curls in excess of an allowable value.

According to the present invention, there is an effect that since no large curls occurs in the vicinity of the welding portion of the skirt portion, the workability when the skirt portion of the shadow mask is fitted in the support portion is improved, and there is a further effect that the stress is rarely applied to the apertured portion of the shadow mask after the skirt portion has been fitted in the support frame, no distortion occurs in the apertured portion, the color selection property of the shadow mask is not deteriorated, and the intimate contact between the skirt portion and the support frame in the vicinity of the welding portion of the skirt portion is secured so that the magnetic property of the shadow mask is not deteriorated.

What is claimed is:

1. A color cathode ray tube including a generally rectangular shadow mask having a curved apertured portion having a multiplicity of electron-transmissive apertures, a curved imperforate portion surrounding and integral with said apertured portion and a skirt portion bent back from a periphery of said curved imperforate portion to form a rearwardly extending wall, and a generally rectangular support frame for suspending said shadow mask by spot welding said skirt portion thereto, within a panel portion of said color cathode ray tube;

at least one of short and long sides of said skirt portion containing only a pair of embossments extending in a direction parallel to a longitudinal axis of said color cathode ray tube on opposite sides of said spot welding point of said support frame and said skirt portion at a center of said at least one of short and long sides of said skirt portion within a distance of one fourth or less of a length of said at least one of short and long sides of said generally rectangular shadow mask from said center.

2. A color cathode ray tube according to claim 1, wherein said pair of embossments are arcuate in cross section and protruding inwardly from said skirt portion.

3. A color cathode ray tube according to claim 1, wherein said pair of embossments are arcuate in cross section and protruding outwardly from said skirt portion.

4. A color cathode ray tube according to claim 1, wherein said long sides of said skirt portion contain the pair of embossments within the distance of one fourth or less of the length of said long sides from said center.

5. A color cathode ray tube according to claim 1, wherein said short sides of said skirt portion contain the pair of embossments within the distance of one fourth or less of the length of said short sides from said center.

6. A color cathode ray tube according to claim 1, wherein both of said short sides and said long sides of said skirt portion contain the pair of embossments within the distance of one fourth or less of the length of both said short sides and said long sides from said center.

* * * * *